US006121733A

United States Patent [19]

Nilssen

[11] Patent Number: 6,121,733

[45] Date of Patent: Sep. 19, 2000

[54] CONTROLLED INVERTER-TYPE FLUORESCENT LAMP BALLAST

[76] Inventor: Ole K. Nilssen, Caesar Dr., Barrington, Ill. 60010

[21] Appl. No.: 08/274,481

[22] Filed: Jul. 13, 1994

Related U.S. Application Data

[63] Continuation-in-part of application No. 07/712,454, Jun. 10, 1991, abandoned.

[51] Int. Cl.[7] ..... H05B 41/24

[52] U.S. Cl. ..... 315/224; 315/247; 315/205; 315/219; 315/224; 315/DIG. 7; 315/226

[58] Field of Search ..... 315/247, 226, 315/205, DIG. 7, DIG. 5, 219, 224; 363/37, 101, 16, 65, 71; 323/205, 206, 207

[56] References Cited

U.S. PATENT DOCUMENTS

| | | | |
|---|---|---|---|
| 4,042,856 | 8/1977 | Steigerwald | 315/246 |
| 4,199,710 | 4/1980 | Knoll | 315/205 |
| 4,251,752 | 2/1981 | Stolz | 315/206 |
| 4,307,353 | 12/1981 | Nilssen | 331/113 A |
| 4,723,098 | 2/1988 | Grubbs | 315/306 |
| 4,763,239 | 8/1988 | Ball | 363/98 |
| 4,954,754 | 9/1990 | Nilssen | 315/219 |
| 4,963,795 | 10/1990 | Nilssen | 315/205 |
| 5,001,400 | 3/1991 | Nilssen | 315/209 R |
| 5,013,974 | 5/1991 | Nilssen | 315/244 |
| 5,041,766 | 8/1991 | Fiene et al. | 315/219 |
| 5,084,653 | 1/1992 | Nilssen | 315/219 |
| 5,115,347 | 5/1992 | Nilssen | 315/247 |

*Primary Examiner*—Arnold Kinkead

[57] ABSTRACT

Unfiltered full-wave-rectified 60 Hz power line voltage is supplied to a first self-oscillating series-resonance-loaded inverter, the high frequency output current from which is magnitude-controlled, rectified and used for maintaining a substantially constant-magnitude DC voltage on an energy-storing capacitor. This constant-magnitude DC voltage is used in combination with the unfiltered full-wave-rectified 60 Hz power line voltage for powering a second self-oscillating series-resonance-loaded inverter, the high frequency current output from which is used for powering a fluorescent lamp load. By frequency-modulating the first inverter at a 120 Hz rate, the current drawn from the power line is made to be of such waveshape as to result in a power factor well in excess of 90% while at the same time having a content of under 20% of odd triplets of third harmonic currents. The high frequency current provided to the fluorescent lamp load has a crest factor not in excess of 1.7.

20 Claims, 5 Drawing Sheets

CONTROLLED INVERTER-TYPE FLUORESCENT LAMP BALLAST

RELATED APPLICATIONS

Instant application is a Continuation-in-Part of Ser. No. 07/712,454 filed Jun. 10, 1991, now abandoned.

BACKGROUND OF THE INVENTION

1. Field of the Invention

The present invention relates to power-line-operated inverter-type power supplies for gas discharge lamps, especially of a type drawing power from the power line with a high power factor and with only a small amount of third harmonic current components.

2. Description of Prior Art

To provide a substantially constant-magnitude high frequency output current, an inverter-type ballast for a gas discharge lamp normally requires to be supplied with a nearly constant-magnitude DC voltage; and, when powered from a DC voltage obtained by straight-forward rectification and filtering of ordinary 60 Hz power line voltage, such a power supply draws current from the power line with a rather poor power factor.

Power factor correction is sometimes provided; but the associated power factor correction circuitry ordinarily involves the use of rather costly, bulky and energy-robbing 60 or 120 Hz inductors.

In particular, power supplies for gas discharge lamps must provide to such lamps an operating current of fairly low crest factor; yet, to be acceptable in most commercial applications, such power supplies must draw power from the power line with a high power factor as well as with a minimum amount of third harmonic current components.

SUMMARY OF THE INVENTION

Objects of the Invention

A basic object of the present invention is that of providing for a cost-effective inverter-type power supply means for gas discharge lamps.

A more specific object is a power-line-operated inverter-type power supply operable to provide to a gas discharge lamp a high frequency current of relatively low crest factor, yet drawing power from the power line with a relatively high power factor and low content of third harmonic current components.

Another object is an electronic fluorescent lamp ballast operable to power its lamp load with a current of low crest factor, yet to draw current from the power line at a high power factor and with minimal third harmonic content.

These as well as other objects, features and advantages of the present invention will become apparent from the following description and claims.

BRIEF DESCRIPTION

Unfiltered full-wave-rectified 60 Hz power line voltage is supplied to a first self-oscillating series-resonance-loaded inverter, the high frequency output current from which is magnitude-controlled, rectified and used for maintaining a substantially constant-magnitude DC voltage on an energy-storing capacitor. This constant-magnitude DC voltage is used in combination with the unfiltered full-wave-rectified 60 Hz power line voltage for powering a second self-oscillating series-resonance-loaded inverter, the high frequency current output from which is used for powering a fluorescent lamp load.

By frequency-modulating the first inverter at a 120 Hz rate, the current drawn from the power line is made to be of such waveshape as to result in a power factor well in excess of 90% while at the same time having a content of under 20% of odd triplets of third harmonic currents. The high frequency current provided to the fluorescent lamp load has a crest factor not in excess of 1.7.

Each of the two inverters is loaded by way of a series-tuned high-Q LC circuit connected across its output. In case of the first inverter, the energy-storing capacitor is charged with unidirectional current derived from across the tank-capacitor of its tuned LC circuit. In case of the second inverter, a pair of fluorescent lamps is series-connected across the tank-capacitor of its tuned LC circuit.

Each inverter has two bipolar transistors, each driven by an associated saturable current transformer that provides for a transistor ON-time dependent on the magnitude of an associated bias voltage.

One of the transistors of each inverter has a control arrangement connected in circuit with its associated saturable transformer and operative to control the magnitude of its associated bias voltage. As the magnitude of the bias voltage is controlled, so are the inverter's oscillating frequency, the magnitude of the voltage across the tank-capacitor, and the magnitude of the current available from the inverter's output.

In case of the first inverter, the magnitude of its bias voltage is automatically controlled such that the magnitude of the DC voltage developing across the energy-storing capacitor is maintained at a pre-determined substantially constant level, while at the same time providing for a desirable waveshape of the current drawn from the power line.

In case of the second inverter, before the fluorescent lamps ignite, the magnitude of the bias voltage is automatically controlled such that the magnitude of the high frequency voltage present across its associated tank-capacitor is maintained at a substantially constant level of magnitude somewhat higher than that of the operating voltage developing across the lamps after they have ignited. Then, after an initial one second period of cathode heating, to cause the lamps to ignite, the magnitude of the bias voltage is—for a period of about 10 milli-seconds—controlled such as to provide across the tank-capacitor a high frequency voltage of magnitude high enough to cause reliable lamp ignition. After the lamps have ignited, the magnitude of the bias voltage is controlled such as to maintain a lamp current of fairly constant magnitude.

DESCRIPTION OF THE PREFERRED EMBODIMENT

Details of Construction

Figures 1, 2:
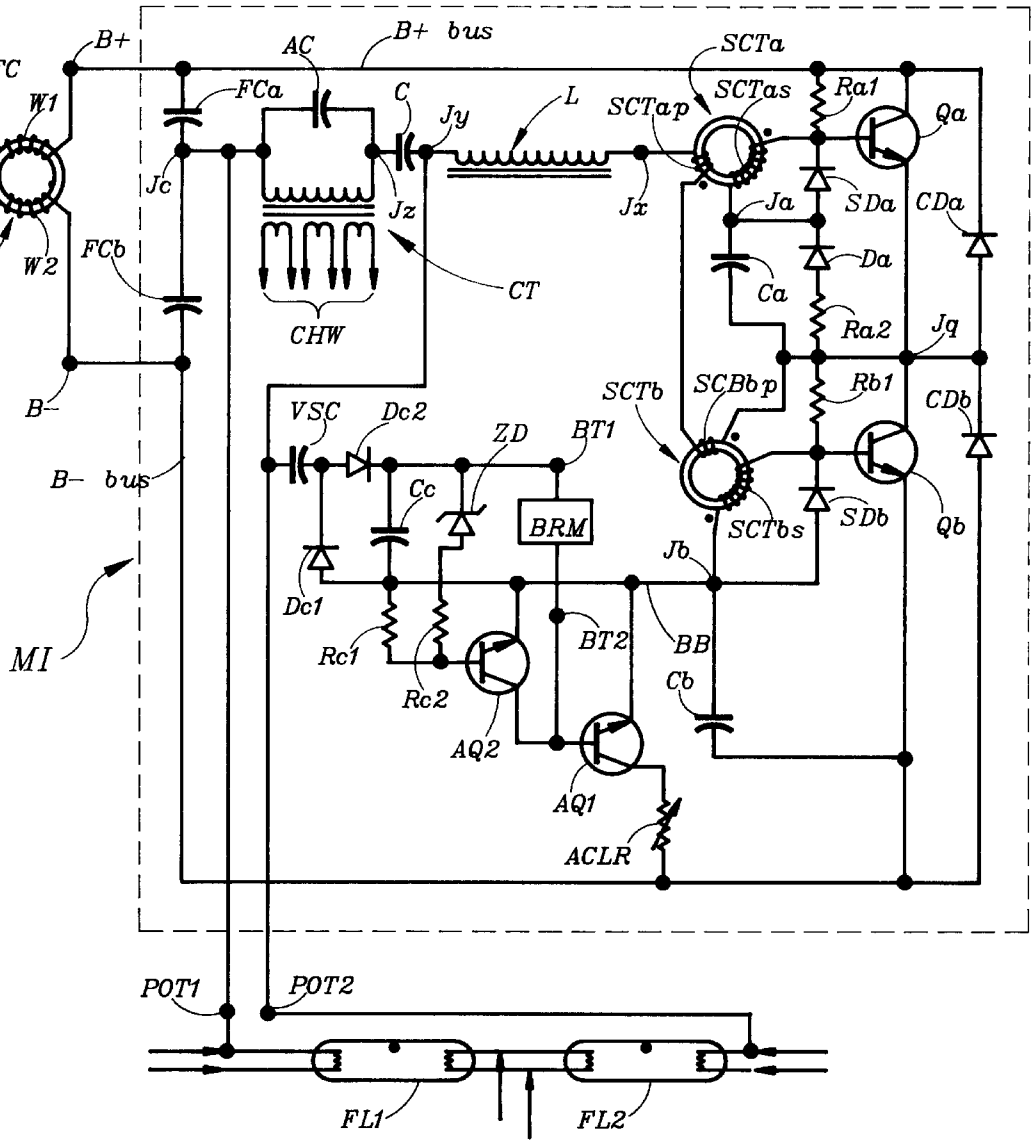
FIG. 1, in the form of an inverter-type power-line-operated fluorescent lamp ballast, diagrammatically illustrates an inverter of the type used for the first and second inverters.
FIG. 2 shows details of part of the control circuitry used in the ballast of FIG. 1.

In FIG. 1, a source S of ordinary 120 Volt/60 Hz power line voltage is applied to power input terminals PITa and PITb; which terminals, in turn, are connected with a bridge rectifier BR. The DC output from bridge rectifier BR is applied to a DC+ terminal and a DC− terminal, with the DC+ terminal being of positive polarity. A high-frequency filter capacitor HFFC is connected between the DC+ terminal and the DC− terminal. A first winding w1 of an EMI suppression inductor SI is connected between the DC+ terminal and a B+ terminal; and a second winding W2 of EMI suppression inductor SI is connected between the DC− terminal and a B− terminal. The B+ and the B− terminals are respectively connected with a B+ bus and a B− bus.

A filter capacitor FCa is connected between the B+ bus and a junction Jc; a filter capacitor FCb is connected between junction Jc and the B− bus. A switching transistor Qa is connected with its collector to the B+ bus and with its emitter to a junction Jq; a switching transistor Qb is connected with its collector to junction Jq and with its emitter to the B− bus. A commutating diode CDa is connected between the B+ bus and junction Jq, with its cathode connected with the B+ bus; a commutating diode CDb is similarly connected between junction Jq and the B− bus.

A saturable current transformer SCTa has a secondary winding SCTas connected between the base of transistor Qa and a junction Ja; a saturable current transformer SCTb has a secondary winding SCTbs connected between the base of transistor Qb and a junction Jb. Saturable current transformers SCTa and SCTb, respectively, have primary windings SCTap and SCTbp; which primary windings are series-connected between junction Jq and a junction Jx.

A resistor Ra1 is connected between the collector and the base of transistor Qa; a resistor Rb1 is connected between the collector and the base of transistor Qb. A capacitor Ca is connected between junction Ja and the emitter of transistor Qa; a capacitor Cb is connected between junction Jb and emitter of transistor Qb. A diode Da is connected with its cathode to junction Ja and, by way of a leakage resistor Ra2, with its anode to the emitter of transistor Qa. A shunt diode SDa is connected between the base of transistor Qa and junction Ja, with its anode connected with junction Ja. A shunt diode SDb is similarly connected between the base of transistor Qb and junction Jb.

An auxiliary transistor AQ1 is connected with its emitter to junction Jb and with its collector to the B− bus by way of an adjustable current-limiting resistor ACLR.

A tank-inductor L is connected between junction Jx and a junction Jy; and a tank-capacitor C is connected between junction Jy and a junction Jz. The primary winding of a cathode transformer CT is connected between junctions Jz and Jc, as is also an auxiliary capacitor AC. Cathode transformer CT has three secondary cathode heater windings collectively designated CHW.

A first power output terminal POT1 is connected with junction Jc; a second power output terminal POT2 is connected with junction Jy. First and second fluorescent lamps FL1 and FL2 are series-connected between power output terminals POT1 and POT2.

A voltage sampling capacitor VSC is connected between junction Jy and the cathode of a diode Dc1. The anode of diode Dc1 is connected with a bias bus BB, which is connected with junction Jb as well as with the emitter of auxiliary transistor AQ1. The anode of a diode Dc2 is connected with the cathode of diode Dc1; and the cathode of diode Dc2 is connected with the cathode of a Zener diode ZD.

A second auxiliary transistor AQ2 is connected with its emitter to bias bus BB and with its collector to the base of auxiliary transistor AQ1. A resistor Rc1 is connected between the base and the emitter of auxiliary transistor AQ2. A resistor Rc2 is connected between the base of auxiliary transistor AQ2 and the anode of Zener diode ZD.

A bistable resistor means BRM has a first terminal BT1 connected with the cathode of Zener diode ZD and a second terminal BT2 connected with the base of auxiliary transistor AQ1.

The elements connected together between the B+ and B− terminals on the one side and the POT1 and POT2 terminals on the other side is referred-to as main inverter MI.

FIG. 2 illustrates details of bistable resistor means BRM.

In FIG. 2, the emitters of first and second "bistable" transistors BQ1 and BQ2 are both connected with terminal BT2. The collector of transistor BQ1 is connected with terminal BT1 by way of a resistor BR1; the collector of transistor BQ2 is connected with terminal BT1 by way of a resistor BR2. A resistor BR3 is connected between terminal BT1 and the base of transistor BQ2. A resistor BR4 is series-connected with a timing capacitor BTC to form a series-combination; and this series-combination is connected between the collector of transistor BQ1 and the base of transistor BQ2. A resistor BR5 is connected between the collector of transistor BQ2 and the base of transistor BQ1.

Figure 5:
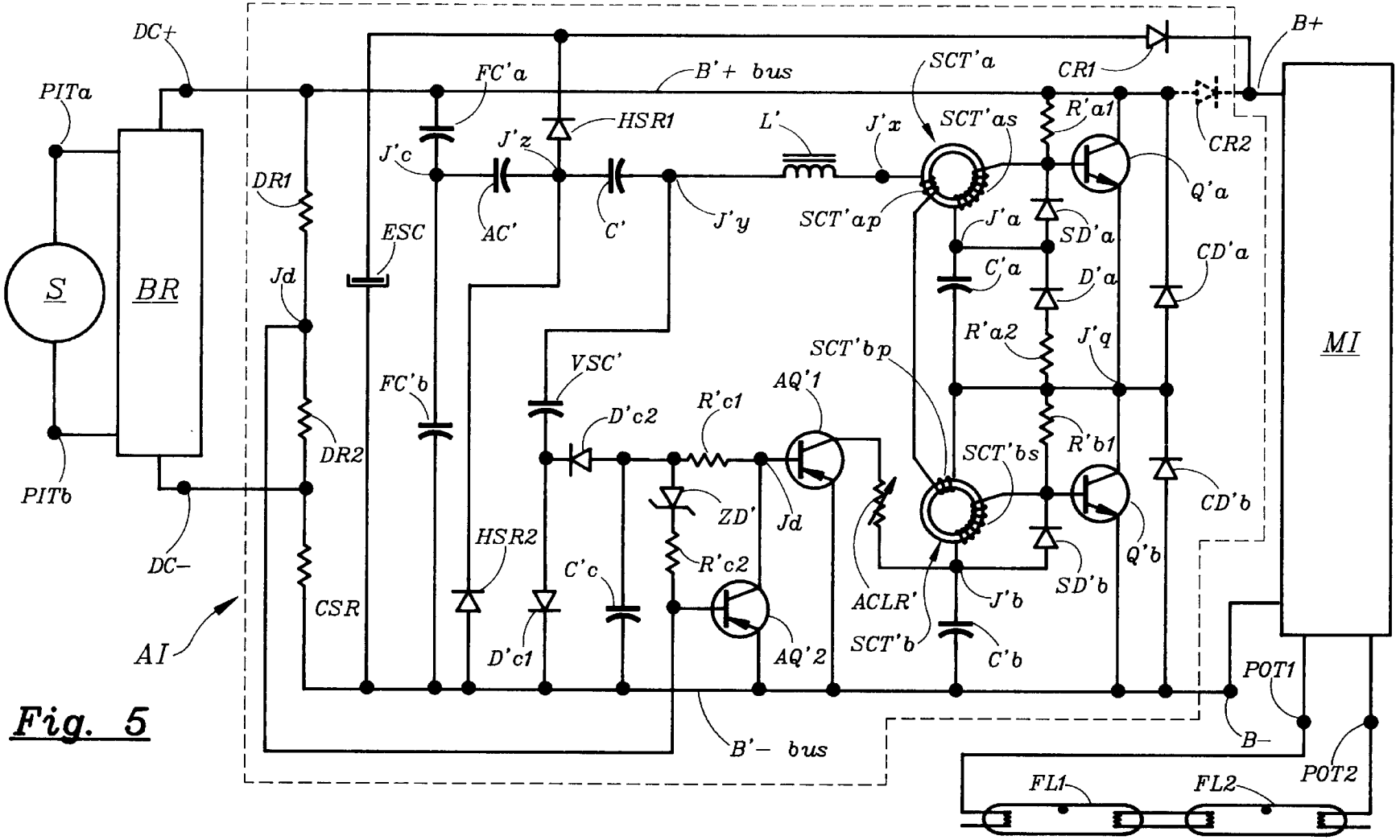
FIG. 5 illustrates a preferred embodiment of the present invention, including the first and second inverters.

FIG. 5 illustrates the preferred embodiment of the present invention.

In FIG. 5, a source S of ordinary 120 Volt/60 Hz power line voltage is applied to power input terminals PITa and PITb; which terminals, in turn, are connected with a bridge rectifier BR. The DC output from bridge rectifier BR is applied to a DC+ terminal and a DC− terminal, with the DC+ terminal being of positive polarity. The DC+ terminal is connected with a B'+ bus, and the DC− terminal is connected with a B'− bus by way of a current sensing resistor CSR.

A resistor DR1 is connected between the DC+ terminal and a junction Jd; and a resistor DR2 is connected between junction Jd and the DC− terminal.

An energy-storing capacitor ESC is connected between the B'− bus and the anode of a commutating rectifier CR1, the cathode of which is connected with the B+ terminal of main inverter MI. Another commutating rectifier CR2 is connected between the B'+ bus and the B+ terminal, its cathode being connected with the B+ terminal. The B− terminal of main inverter MI is connected with the B'− bus.

Fluorescent lamps FL1 and FL2 are series-connected across power output terminals POT1 and POT2 of main inverter MI.

A filter capacitor FC'a is connected between the B'+ bus and a junction J'c; a filter capacitor FC'b is connected between junction J'c and the B'− bus. A switching transistor Q'a is connected with its collector to the B'+ bus and with its emitter to a junction J'q; a switching transistor Q'b is connected with its collector to junction J'q and with its emitter to the B'+ bus. A commutating diode CD'a is connected between the B'+ bus and junction J'q, with its cathode connected with the B'+ bus; a commutating diode CD'b is similarly connected between junction J'q and the B'− bus.

A saturable current transformer SCT'a has a secondary winding SCT'as connected between the base of transistor Q'a and a junction J'a; a saturable current transformer SCT'b has a secondary winding SCT'bs connected between the base of transistor Q'b and a junction J'b. Saturable current transformers SCT'a and SCT'b, respectively, have primary windings SCT'ap and SCT'bp; which primary windings are series-connected between junction J'q and a junction J'x.

A resistor R'a1 is connected between the collector and the base of transistor Q'a; a resistor R'b1 is connected between the collector and the base of transistor Q'b. A capacitor C'a is connected between junction J'a and the emitter of transistor Q'a; a capacitor C'b is connected between junction J'b and emitter of transistor Q'b. A diode D'a is connected with its cathode to junction J'a and, by way of a leakage resistor R'a2, with its anode to the emitter of transistor Q'a. A shunt diode SD'a is connected between the base of transistor Q'a and junction J'a, with its anode connected with junction J'a. A shunt diode SD'b is similarly connected between the base of transistor Q'b and junction J'b.

A tank-inductor L' is connected between junction J'x and a junction J'y; and a tank-capacitor C' is connected between junction J'y and a junction J'z. An auxiliary capacitor AC' is connected between junctions J'z and J'c.

A first high speed rectifier HSR1 is connected with its anode to junction J'z and with its cathode to the anode of rectifier CR1. A second high speed rectifier HSR2 is connected with its cathode to junction J'z and with its anode to the B'− bus.

A first auxiliary transistor AQ'1 is connected with its emitter to the B'− bus and with its collector to junction J'b by way of an adjustable current-limiting resistor ACLR'.

A voltage sampling capacitor VSC' is connected between junction J'y and the anode of a diode D'c1. The cathode of diode D'c1 is connected with the B'− bus. The cathode of a diode D'c2 is connected with the anode of diode D'c1; and the anode of diode D'c2 is connected with the anode of a Zener diode ZD'. A filter capacitor C'c is connected between the anode of diode D'c2 and the B'− bus. A resistor R'c1 is connected between the anode of diode D'c2 and the base of transistor AQ'1.

A second auxiliary transistor AQ'2 is connected with its emitter to the B'− bus and with its collector to the base of auxiliary transistor AQ'1; which base is connected with junction Jd. A resistor R'c2 is connected between the base of auxiliary transistor AQ'2 and the cathode of Zener diode ZD'.

The elements connected together between the DC+ and DC− terminals and the B+ and B− terminals are referred-to as auxiliary inverter AI.

Figure 6:
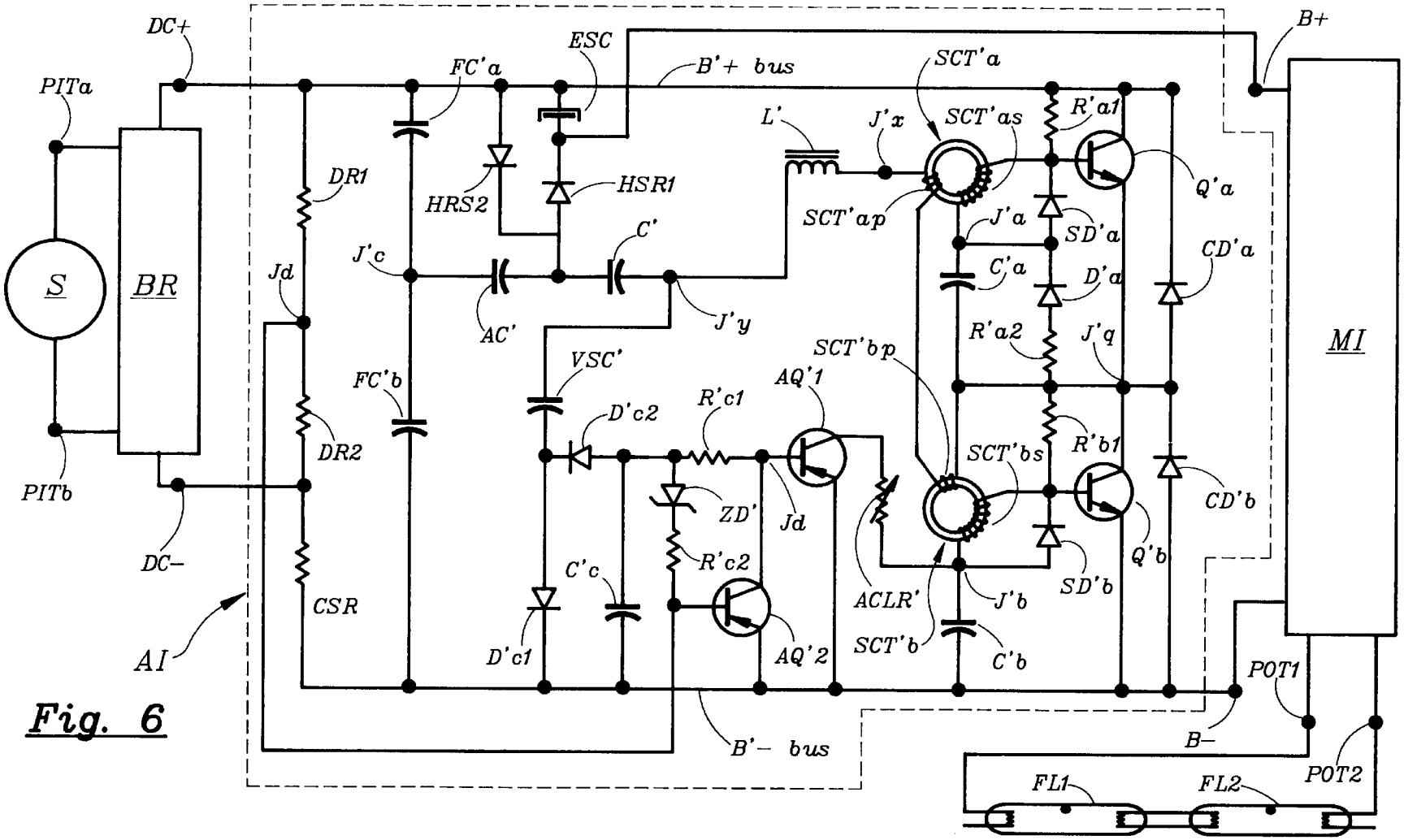
FIG. 6 illustrates an alternative embodiment of the present invention.

FIG. 6 illustrates an alternative ambodiment of the present invention.

The arrangement of FIG. 6 is identical to that of FIG. 5 except as follows.

In FIG. 6: (i) rectifier CR1 has been replaced with a short circuit; (ii) rectifier CR2 has been replaced with an open circuit; (iii) the anode of rectifier HSR2 has been disconnected from the B'− bus and connected with the B'+ bus instead; and (iv) one of the terminals (the negative terminal) of energy storing capacitor ESC has been disconnected from the B'− bus and connected with the B'+ bus instead.

Figure 4:
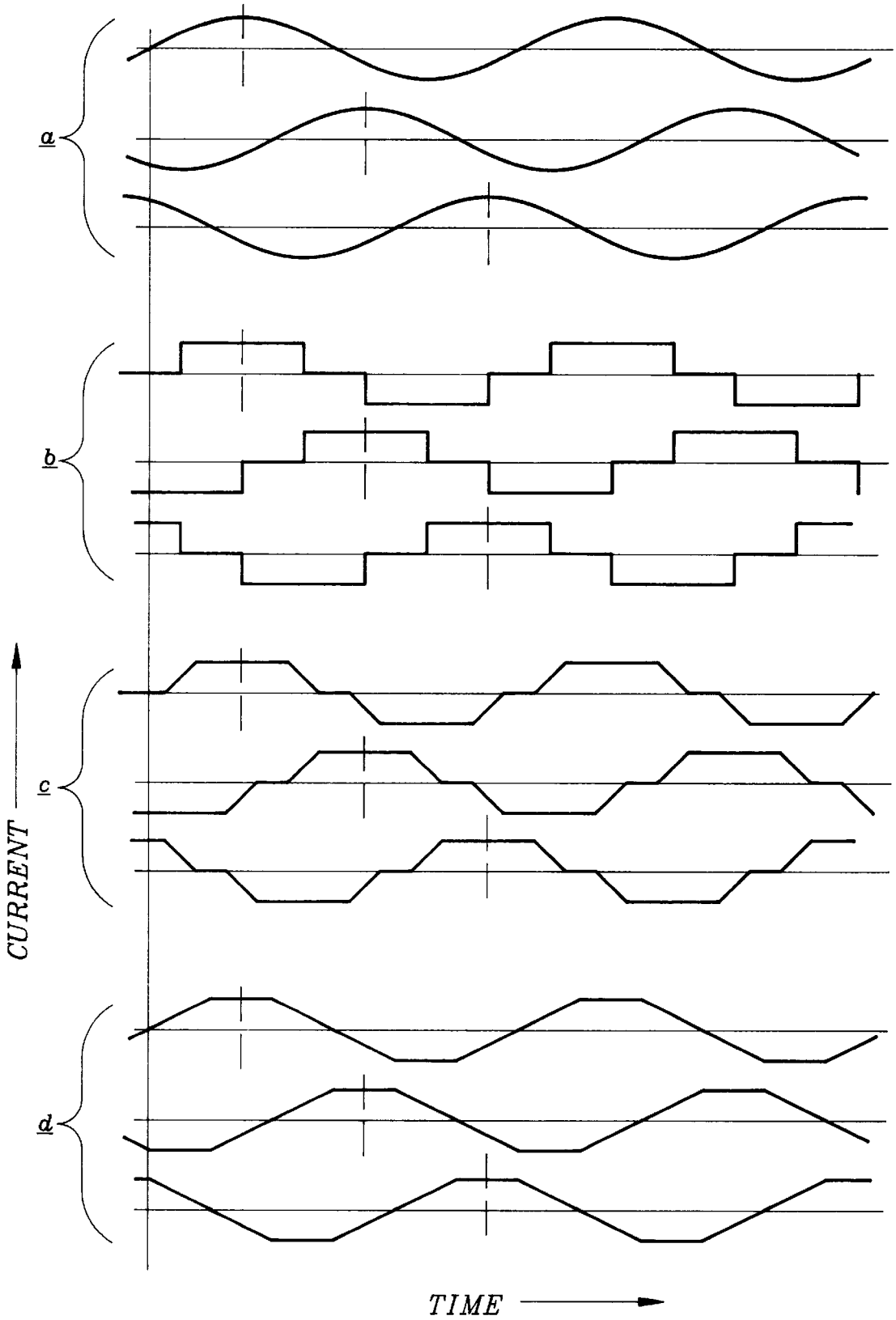
FIG. 4 shows various power line current waveforms having net zero current in the neutral wire of a three phase system.

Details re Waveforms of FIG. 4

In a situation of an ordinary three-phase power distribution system, where each individual phase supplies a 60 Hz sinusoidal voltage, the waveforms of FIGS. 4*a*–4*d* represent the currents resulting in each of the three power conductors under four different types of load conditions. In each of these four cases, the current flowing in the neutral conductor will be zero under conditions of symmetrical loading on each phase.

FIG. 4*a* represents a situation where each of the loads draws a sinusoidal current; which, as is well known, results in zero current flowing in the three phase neutral conductor. That this is so may be ascertained by simply adding the instantaneous magnitudes of the three different waveforms: at each point along the time axis, the sum will be zero.

FIG. 4*b* represents a situation where each of the loads draws a current of a constant magnitude for two thirds of the total duration of each half cycle of the power line voltage, and then a zero-magnitude current for the remainder of each half cycle. In this case the three currents also will add up to zero on an instantaneous basis all along the time axis.

FIGS. 4*c* and 4*e* represent situations equivalent to that of FIG. 4*b*, except for having the current magnitudes increase and decrease more or less gradually as contrasted with the abrupt increases and decreases of the current magnitudes in FIG. 4*b*. In each of these cases the three currents also will add up to zero on an instantaneous basis all along the time axis.

Details of Operation

Figure 3:
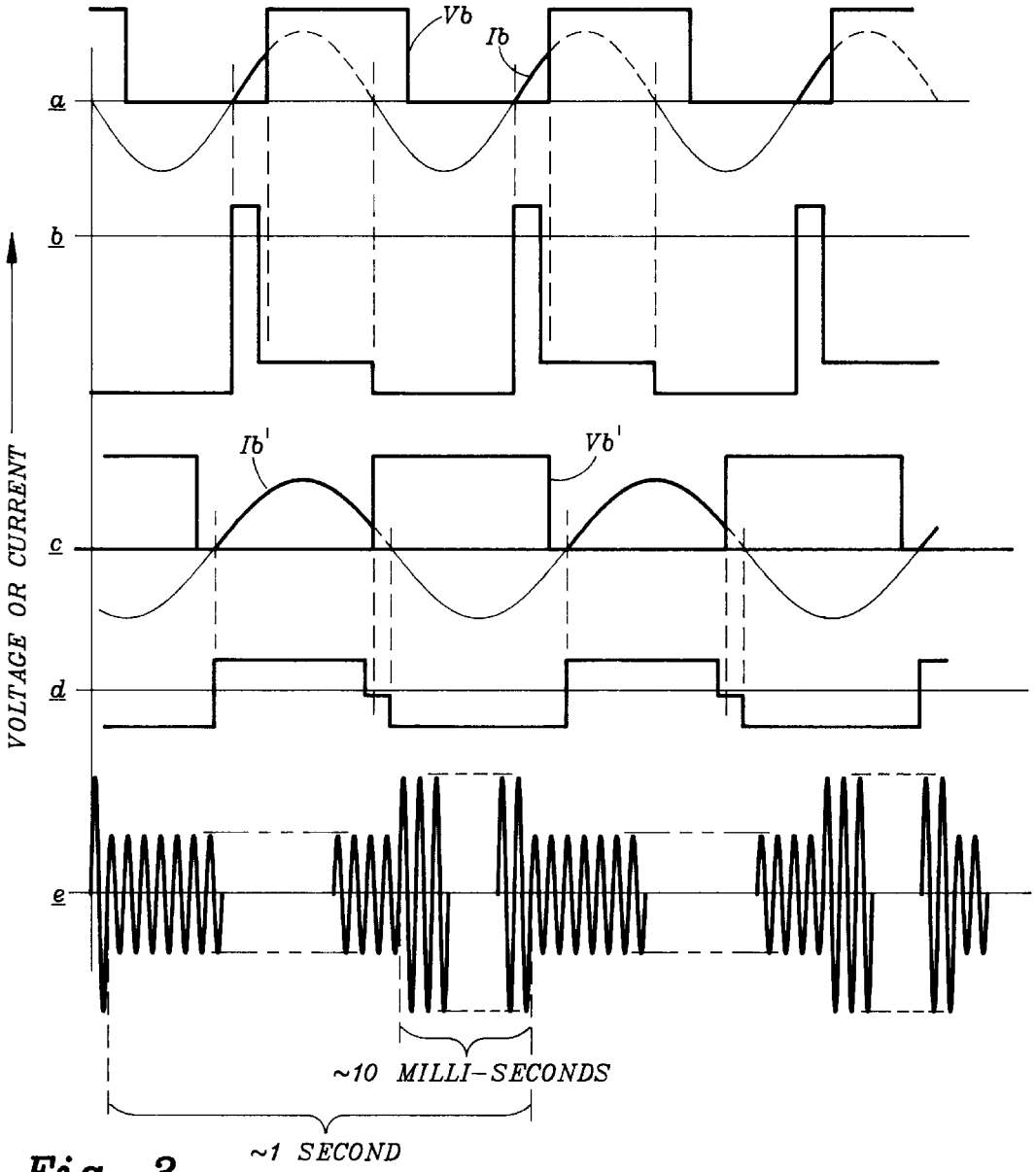
FIG. 3 illustrates various voltage and current waveforms associated with the operation of the ballast of FIG. 1.

The basic operation of the half-bridge inverter of FIG. 1 is conventional and is explained in conjunction with FIG. 3 of U.S. Pat. No. 4,307,353 to Nilssen.

For a given magnitude of the DC supply voltage, due to the effect of the high-Q LC circuit, the magnitude of the current provided to the fluorescent lamp load (or to any other load presented to the output) is a sensitive function of the frequency and the waveshape of the inverter's output voltage; which output voltage is a substantially squarewave voltage of controllable frequency and with peak-to-peak magnitude about equal to that of the instantaneous magnitude of the DC voltage present between the B− bus and the B+ bus.

The frequency of the inverter's squarewave output voltage is a sensitive function of the natural resonance frequency of the high-Q LC circuit as well as of the duration of the forward conduction period (i.e., the ON-period) of the two inverter switching transistors; which duration, in turn, is a sensitive function of the saturation characteristics of saturable current transformers SCTa and SCTb as combined with the magnitude of the bias voltages present on capacitors Ca and Cb. That is, the duration of the forward conduction period (the ON-time) of each switching transistor is determined by the volt-second product sustainable by its associated saturable current transformer as well as by the magnitude of the negative bias on capacitors Ca and Cb: the higher the volt-second product available before saturation, the longer the ON-time; the higher the negative bias on the Ca/Cb capacitors, the shorter the ON-time.

In the circuit arrangement of FIG. 1, the magnitude of the negative voltage on capacitors Ca and Cb is determined by the magnitude of the current provided to the bases of transistors Qa and Qb, less any current drained away through resistors Ra2 and AQ1/ACLR, all respectively. (Of course, a small amount of current is also drained away from bias capacitors Ca and Cb by resistors Ra1 and Rb1, respectively. However, this amount of charge leakage is in most situations negligible. Resistors Ra1 and Rb1 are principally used for getting the inverter to initiate oscillation.)

The magnitude of the base current provided to each transistor is directly proportional to the magnitude of the current flowing through the primary windings of saturable current transformers SCTa and SCTb. Thus, assuming transistor AQ1 to be conducting, for given values of resistors R2a and ACLR: the higher the magnitude of the inverter's output current, the higher the magnitude of the negative voltage on capacitors Ca and Cb.

Thus, for given values of resistors Ra2 and ACLR (assuming transistor AQ1 to be conducting), the circuit of FIG. 1 provides for a high degree of regulation of the magnitude of the inverter's output current.

By selecting a suitable resistance value for resistor Ra2, and assuming transistor AQ1 to be conducting, the magnitude of the inverter's output current may be adjusted by adjusting the resistance value of ACLR: a relatively low resistance value leads to an inverter output current of relatively high magnitude; a relatively high resistance value leads to an inverter output current of relatively low magnitude.

The higher the magnitude of the negative voltage on each bias capacitor, the higher the magnitude of the voltage that has to be provided from the secondary winding of each saturable current transformer; which, in turn, leads to a correspondingly shorter period before saturation is reached. Thus, as the magnitude of the negative bias on each bias capacitor is increased, the duration of each transistor's forward conduction period (ON-time) is decreased; which, in turn, leads to a reduction in the magnitude of the inverter's output current in comparison with what it otherwise would have been.

Whereas the base current provided to each transistor has to flow from its associated bias capacitor, the reverse or reset current provided from each of the saturable current transformer's secondary windings does not flow from the bias capacitor, but rather flows in a separate path through the reverse shunt diode (SDa or SDb) shunting the secondary winding of each saturable current transformer.

More particularly, the circuit and control arrangement of FIG. 1 operates as follows.

As power is applied at power input terminals PITa/PITb, the inverter starts to oscillate at a frequency near the natural self-resonance frequency of the LC circuit. The resulting inverter output current results in a positive feedback current provided to each base; and this feedback current, in turn, causes a negative bias to build up on each of bias capacitors Ca/Cb. As the magnitude of the negative bias voltage increases, the inverter's oscillation frequency increases as well. As a result, the magnitude of the inverter output current will stabilize at a some level determined by the effective resistance values of resistors Ra2 and AQ1/ACLR.

Transistor AQ1 conducts to a degree dependent on the magnitude of the base current it receives; which magnitude, in turn, depends on: (i) the magnitude of the high frequency voltage present at junction Jy; (ii) the reactance value of capacitor VSC; (iii) the magnitude of the Zener voltage of Zener diode ZD; and (iv) the effective resistance value of bistable resistance means BRM.

More particularly, the control circuit consisting of principal elements AQ1, ACLR, BRM, AQ2, ZD and VSC, operates as follows: (i) capacitor VSC is of small capacitance value relative to that of tank capacitor C, and—from the perspective of the magnitudes of the voltages present within the control circuit—may be considered as representing a current source; (ii) thus, the magnitude of the high frequency current supplied via capacitor VSC is a measure of the magnitude of the high frequency voltage present at junction Jy; (iii) the high frequency current provided via capacitor VSC is rectified and filtered, and results in a corresponding unidirectional current flowing through resistance gleans BRM and into the base of transistor AQ1, thereby causing this transistor to become fully conductive; (iv) as the magnitude of the high frequency current increases, so does the magnitude of the unidirectional current flowing through resistance means BRM as well as the magnitude of the DC voltage developing across resistance means BRM; (v) eventually a point is reached at which the magnitude of this DC voltage gets to be so high as to cause current to flow through Zener diode ZD and into the base of transistor QA2; (vi) as current flows into the base of transistor AQ2, it becomes conductive; (vii) as transistor AQ2 becomes conductive, it robs base current from transistor AQ1, thereby making transistor AQ1 less conductive; (viii) as transistor AQ1 becomes less conductive, the magnitude of the bias voltage across capacitor Cb will increase, thereby shortening the ON-time of transistor Qb; and (ix) the shortening ON-time of transistor Qc will cause the magnitude of the high frequency current supplied to tank capacitor C to decrease, thereby decreasing the magnitude of he high frequency voltage present at junction Jy.

Thus, a negative feedback loop exists: as the magnitude of the high frequency voltage provided at junction Jy increases beyond a pre-established level (which, for a given value of capacitor VSC, is determined by the Zener voltage of Zener diode ZD and the effective resistance value of resistance means BRM), the ON-time of transistor Qb becomes proportionally shortened. As a net result, the magnitude of the high frequency voltage at junction Jy will be regulated such as—in effect—not to exceed the above-indicated pre-established level. Thus, as long as the magnitude of the B+ supply voltage exceeds a certain minimum level, further increases in the magnitude of the B+ supply voltage will not cause further increases in the magnitude of the high frequency voltage.

By varying the effective resistance value of bistable resistance means BRM, the magnitude of the high frequency voltage at junction Jy will correspondingly vary. Bistable resistance means BRM is of such a nature as to self-oscillate between two distinct states: (i) a first state in which transistor BQ1 is ON and transistor BQ2 is OFF; and (ii) a second state in which transistor BQ1 is OFF and transistor BQ2 is ON. The components of bistable resistance means BRM were so chosen as to cause the first state to exist for about 10 milli-seconds and the second state to exist for about 1000 milli-seconds. As a consequence, resistors BR1 and BR2 are alternatingly switched in and out, thereby causing resistance means BRM to appear as a relatively low resistance value (equivalent to the effective resistance value of resistor BR2) for about 10 milli-seconds once each 1000 milli-seconds, while otherwise appearing as a relatively high resistance value (i.e., the effective resistance value of BR1).

As a result of causing bistable resistance means to alternate on the above-indicated manner, the magnitude of the high frequency voltage at junction Jy alternates correspondingly—being of a relatively large magnitude for 10 milli-seconds out of every 1000 milli-seconds.

The magnitude of the high frequency voltage during the indicated 10 milli-second periods is high enough to cause the fluorescent lamps to ignite, but only after the lamp cathodes have become thermionic. When provided with the proper amount of cathode heating power, the lamp cathodes will become thermionic within a period of less than 1000 milli-seconds.

With the fluorescent lamps connected and fully operating (i.e., fully loading the LC circuit), the magnitude of the high frequency voltage at junction Jy is kept below that magnitude required to cause current to flow into the base of transistor AQ2; which means that transistor AQ1 will be fully conductive. At this point, the control circuit is effectively disabled; and the magnitude of the lamp current is then determined by the resistance value of resistor ACLR: varying ACLR causes the magnitude of the lamp current to vary.

The resistance value of resistor Ra2 is selected such that the ON-time of transistor Qa corresponds to nearly a 50% duty-cycle. Similarly, the minimum resistance value of ACLR (which corresponds to maximum lamp current) is selected such that the ON-time of transistor Qb corresponds to nearly a 50% duty-cycle.

Heating of the lamp cathodes is accomplished by way of cathode transformer CT; which transformer is connected in parallel with auxiliary capacitor AC, the capacitance value of which is very large compared with that of tank capacitor C. Thus, the cathodes are heated with a substantially sinusoidal high frequency voltage.

When the circuit of FIG. 1 operates with no load (as before the lamp cathodes have become thermionic), the RMS magnitude of the high frequency voltage present at junction Jy is limited by the indicated negative feedback to be somewhat higher than the magnitude of the high frequency voltage present at junction Jy with the lamps connected and operating, but not so high as to cause instant-starting of the lamps. The magnitude of the cathode heating voltages provided during this no-load condition is chosen to be such as to cause cathode incandescence to occur within about one second. As a result, the lamps will normally ignite in a rapid-start manner on the first occasion where the magnitude of the high frequency output voltage is made extra high for the indicated 10 milli-second period.

During the 10 milli-second period, the magnitude of the cathode heating voltages also increases substantially, thereby aiding in lamp ignition. However, on an integrated RMS basis, this brief period of increased cathode heating voltage is of little consequence.

As soon as the lamps ignite, the magnitude of the high frequency voltage at junction Jy will decrease to a level so low that the amount of high frequency current provided via capacitor VSC will be insuffient to cause Zener diode ZD to conduct, thereby causing transistor AQ2 to enter its non-conducting state and to remain there for as long as the lamps remain ignited. As a result, transistor AQ1 will now be fully conducting on a continuous basis. This implies that the 10 milli-second pulses, which will continue to be provided every 1000 milli-seconds, will be of little consequence: they can't turn transistor AQ1 more than fully ON.

If the lamps were to be disconnected, however, the repeatedly provided 10 milli-second pulses will assure that affirmative lamp ignition will occur as soon as fully functional lamps are indeed connected.

As long as transistor AQ1 is conductive, the fluorescent lamps will be powered in a normal manner; and the magnitude of the lamp current flowing will depend on the particular setting of adjustable resistor ACLR.

FIG. 3 depicts various voltage and current waveforms associated with the circuit of FIG. 1.

For a situation with no loading presented to the high-Q LC circuit—that is, with the lamps disconnected, or before the lamps have ignitied—FIG. 3*a* shows the collector-to-emitter voltage Vb of transistor Qb and the corresponding inverter output current Ib. The part of Ib actually flowing through transistor Qb in the forward direction is shown in heavy solid line, the part of Ib flowing through commutating diode CDa is showed in light dashed line, and the part of Ib flowing through either Qa or CDb is shown in light solid line.

FIG. 3*b* shows the base-emitter voltage of transistor Qb as it corresponds to the waveforms of FIG. 3*a*.

For a situation where the LC circuit is substantially fully loaded by the two fluorescent lamps, FIG. 3*c* shows the collector-to-emitter voltage Vb' of transistor Qb and the corresponding inverter output current Ib'. The part of Ib' actually flowing through transistor Qb in the forward direction is shown in heavy solid line, the part of Ib' flowing through commutating diode CDa is showed in light dashed line, and the part of Ib' flowing through either Qa or CDb is shown in light solid line.

FIG. 3*d* shows the base-emitter voltage of transistor Qb as it corresponds to the waveforms of FIG. 3*c*.

FIG. 3*e* shows the waveshape of the high-frequency voltage present across the tank-capacitor under the condition of an unloaded LC circuit: a continuous substantially sinusoidal voltage of a relatively low magnitude, interrupted once each second (i.e., 1000 milli-seconds) with a 10 milli-second long burst of relatively high-magnitude substantially sinusoidal voltage.

In the arrangement of FIG. 5, there are two inverters: one is main inverter MI, whose operation is already described in connection with FIG. 1; the other is an auxiliary inverter, whose operation is essentially the same as that of main inverter MI. However, this auxiliary inverter is used differently.

More particularly, its high frequency output is rectified via high speed rectifiers HSR1 and HSR2, and the resulting unidirectional current is used for charging energy-storing capacitor ESC. In the absence of any loading on this energy-storing capacitor, the voltage-magnitude to which it charges is determined by the characteristics of the negative feedback control circuit: in the same manner as is the maximum magnitude of open circuit output voltage determined in the circuit arrangement of FIG. 1.

More particularly, the maximum voltage to which capacitor ESC charges is determined by the capacitance ratio between auxiliary capacitor AC' and tank capacitor C', as well as by the magnitude to which the high frequency voltage at junction J'y is regulated.

With commutating rectifier CR2 non-connected, or with the magnitude of the voltage on capacitor ESC larger than the peak magnitude of the rectified power line voltage, main inverter MI will be powered entirely from the voltage on capacitor ESC.

However, with commutating rectifier CR2 connected, and with the magnitude of the voltage on capacitor ESC lower than the peak magnitude of the rectified power line voltage, main inverter MI gets powered directly from the rectified power line voltage as long as the instantaneous magnitude of this rectified power line voltage is larger than the magnitude of the voltage on capacitor ESC. Then, when the instantaneous magnitude of the rectified power line voltage is lower than the magnitude of the voltage on capacitor ESC, main inverter MI gets powered by the voltage on capacitor ESC.

Otherwise, by virtue of the voltage established at junction Jd by action of the voltage divider consisting of resistors DR1 and DR2, as combined with the voltage established across current sensing resistor CSR (which is a resistor of relatively low resistance value, such as perhaps 1 to 10 Ohm), a situation is established whereby the instantaneous magnitude of the current drawn from the power line is prevented from exceeding a certain pre-established fraction of the instantaneous magnitude of the power line voltage; which pre-established fraction is determined by the resistance value of resistor DR2 versus that of resistor DR1.

More particularly, if the instantaneous magnitude of the current drawn from the power line through resistor CSR were to generate a larger voltage across CSR than the voltage established across resistor DR2, the net result would be that the voltage established at junction Jd would be negative with respect to the B'− bus. Thus, whenever the instantaneous magnitude of the voltage present across resistor CSR is larger than that of the voltage present across resistor DR2, junction Jd will present a voltage to the base of transistor AQ'2 that is negative with respect to its emitter, thereby causing this transistor to become more conductive, thereby causing transistor AQ'1 to become less conductive, thereby reducing the magnitude of the current delivered to capacitor ESC, thereby reducing the magnitude of the current drawn from the power line, etc.

The arrangement of FIG. 6 operates in the same manner as that of FIG. 5 except that energy-storing capacitor ESC has now been repositioned in such manner that its voltage is now added to the rectified power line voltage before being presented to main inverter MI.

Figure 7:
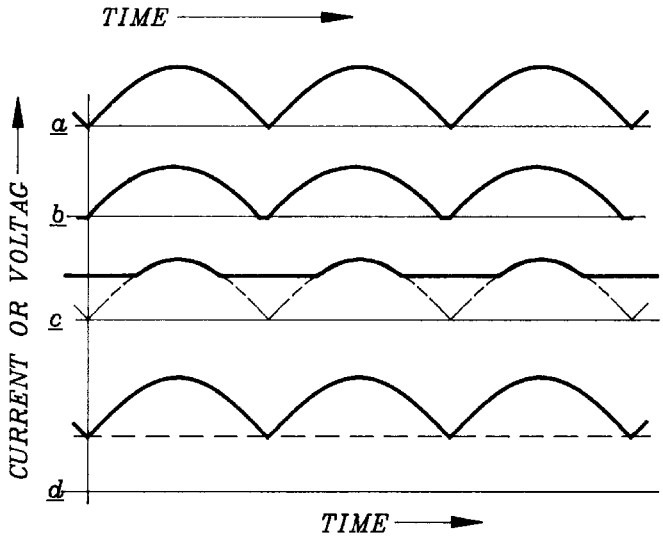
FIG. 7 illustrates some of the voltage and current waveforms associated with the embodiments of FIGS. 5 and 6.

FIG. 7 depicts various voltage and current waveforms associated with the arrangements of FIGS. 5 and 6.

FIG. 7*a* indicates the waveshape of the full-wave-rectified power line voltage, which is present between the DC+ and the DC− terminals.

FIG. 7*b* indicates the waveshape of the current drawn from the power line; which waveshape, under most conditions, is nearly sinusoidal.

FIG. 7*c* indicates the waveshape of the voltage presented to main inverter MI in the arrangement of FIG. 5 under a condition where the peak magnitude of the rectified power line voltage is about 25% higher that the magnitude of the voltage on capacitor ESC.

FIG. 7*d* indicates the waveshape of the voltage presented to main inverter MI in the arrangement of FIG. 6.

Additional Comments a) Detailed information relative to a fluorescent lamp ballast wherein the fluorescent lamp is powered by way of a series-excited parallel-loaded L-C resonant circuit is provided in U.S. Pat. No. 4,554,487 to Nilssen.

b) The instantaneous peak-to-peak magnitude of the squarewave output voltage provided by each of the various half-bridge inverters between junctions Jq and Jc is substantially equal to the instantaneous magnitude of the DC voltage supplied to that inverter.

c) Saturable current transformers SCTa and SCTb require only a miniscule amount of voltage across their primary windings. Hence, the magnitude of the voltage-drop between junctions Jq & Jx is substantially negligible, and the inverter's full output voltage is therefore effectively provided across the LC circuit, which principally consists of tank-capacitor C and tank-inductor L. However, there is a small tuning effect associated with auxiliary capacitor AC of FIG. 1 and capacitor AC' of FIGS. 5 and 6.

d) in FIG. 3, the inverter frequency associated with the waveforms of FIGS. 3*a* and 3*b* is substantially higher than that associated with FIGS. 3*c* and 3*d*.

Also, current Ib is nearly 180 degrees out of phase with the fundamental frequency component of voltage Vb, while current Ib' is almost in phase with voltage Vb'.

e) In the situation associated with the waveform of FIG. 3*b*, the magnitude of the voltage "seen" by the secondary winding of saturable current transformer SCTb is about five times as high as that "seen" by the same secondary winding in the situation associated with FIG. 3*d*.

Correspondingly, the duration of the transistor ON-time in the situation associated with FIG. 3*d* is about five times longer than the transistor ON-time in the situation associated with the waveform of FIG. 3*b*.

f) As may be noticed in FIG. 3*a*, transistor Qb ceases to conduct in its forward direction while a substantial amount of current is still flowing from the inverter's output. After transistor Qb has ceased to conduct, the inverter's output current will continue to flow until the energy in the tank inductor has dissipated itself. However, the output current will continue its flow through commutating diode CDa, thereby discharging its energy into the DC power supply.

g) Forward conduction of a transistor is defined as current flowing, with the aid of forward base drive current, directly between the collector and the emitter; which, in case of transistor Qb for, instance, means that forward current is defined as positive current flowing from its collector to its emitter while drive current is being provided to its base.

A transistor's ON-time is defined as the period during which it conducts current in the forward direction.

h) In FIG. 3 it is noted that the fundamental frequency of the waveforms depicted in FIGS. 3*c* and 3*d* is lower by a certain factor as compared with the frequency associated with the waveforms of FIGS. 3*a* and 3*b*; yet the indicated duration of transistor ON-time associated with the waveforms of FIGS. 3*a* and 3*b* is shorter by a much larger factor as compared with the indicated duration of transistor ON-time associated with the waveforms of FIGS. 3*c* and 3*d*.

In fact, when the transistor ON-time is shortened by a given proportion, the fundamental frequency of the inverter's output voltage increases by a much smaller proportion. In instant case, with each transistor's ON-time shortened by a factor of about five, the inverter frequency increased only by a factor of about 1.3: from about 30 kHz to about 40 kHz.

i) The time constant associated with each bias capacitor and its associated charge leakage means (ex: Da and Ra2) is normally on the order of a single period of the high frequency inverter output voltage. For instance, for a situation where the power line input voltage is 120 Volt/60 Hz, the frequency of the inverter output voltage/current is on the order of 30 kHz, and the total inverter power output falls in the range between 10 and 100 Watt, the values of bias capacitors Ca and Cb might reasonably be in the range from 0.5 to 5 micro-Farad, the value for leakage resistor Ra2 might reasonably be in the range between 5 and 50 Ohm, and adjustable resistor ACLR might reasonably be adjustable over a range between 0 and 50 Ohm.

j) In the circuit arrangement of FIG. 1 there are two distinctly different kinds of current-magnitude-limiting provided. One is the ordinary kind associated with the natural characteristics of a series-excited parallel-loaded resonant LC circuit; another is due to the action of the control circuit associated with auxiliary transistors AQ1 and AQ2.

The former is the principal means for limiting the lamp current; the latter is the principal means for controlling the level at which the lamp current is limited as well as for limiting the inverter's output current in the absence of proper circuit loading.

k) The circuit arrangement of FIG. 1 may be described as an inverter that is loaded by way of a high-Q tuned LC circuit and arranged to self-oscillate by way of positive feedback derived from the inverter 's instantaneous output current (and/or voltage) while at the same time arranged to provide for controllable-magnitude output current (and/or voltage) by way of negative feedback derived from the average absolute magnitude of the inverter's output current (and/or voltage). That is, a larger magnitude output current provides for a larger magnitude bias voltage on capacitors Ca and Cb, thereby causing the inverter frequency to increase and the inverter's output current to decrease.

l) So as to fully reset the saturable cores each cycle, diodes SDa and SDb should each have a relatively high-magnitude forward voltage drop, such as might be obtained by using two ordinary diodes in series. However, instead of using special diodes with high-magnitude forward voltage drops, it is acceptable to use ordinary diodes with added series-resistors, thereby effectively to increase their forward voltage drops.

m) Some of the values associated with operating the ballast with the kind of waveform indicated by FIG. 3*e* are as follows: (i) substantially relaxed specifications for the tank-inductor; (ii) similarly relaxed specifications for the tank-capacitor; (iii reduced glow current prior to lamp ignition, thereby providing for increased lamp life; (iv) much improved lamp starting; (v) substantially reduced idling power; and (vi) more cost-effective compliance with U.L. specifications related to ground-fault current.

n) The RMS magnitude of the cathode heating voltage, which voltage is provided to each of the lamps' thermionic cathodes by way of cathode heating windings CHW, is such as to provide for proper cathode heating during the period before the lamps ignite, as well as on a continuous basis thereafter.

During the brief pulses provided by way of bistable resistor means BRM, the RMS magnitude of the cathode heating voltage is increased to about twice normal value. However, since the duration of each of these pulses is so very brief (about 10 milli-seconds) compared with the duration of each of the periods between such pulses (about 1000 milli-seconds), the net effect on the temperature of the cathodes is negligible. However, with respect to lamp ignition, the effect is substantial and beneficial. The briefly elevated RMS magnitude of the cathode voltage gives rise to ionization of the lamp gas along the cathodes' surfaces, thereby greatly facilitating the ignition of the main gas columns of the lamps.

o) By appropriately modifying the voltage divider means, which in the arrangements of FIGS. 5 and 6 is represented by resistors DR1 and DR2, the waveshape of the current drawn from the power line can be correspondingly modified. For instance, by placing a voltage-limiting means, such as a diode, in parallel with resistor DR2, the line current waveshape can be made to be like that illustrated in FIG. 4*d*.

p) When a resonant LC circuit is series-excited with a voltage source and parallel-loaded by a substantially fixed-magnitude voltage, such as is indeed the case with the arrangement of FIG. 5 (where the load is capacitor ESC; which capacitor, under normal conditions, will indeed be charged to a voltage of substantially fixed magnitude), the magnitude of the current drawn from the voltage source will be substantially constant regardless of the magnitude of the voltage provided from this voltage source.

This constant-voltage to constant-current conversion characteristic is basic with parallel-loaded series-excited resonant LC circuits; which have the characteristic of converting a constant-magnitude voltage series-input to a constant-magnitude current parallel-output; or, conversely, converting a constant-magnitude voltage parallel-output to a constant current series-input.

Thus, without any attempts at changing the frequency of the inverter's output voltage, the waveshape of the current drawn from the power line would have been substantially a continuous constant magnitude, regardless of the instantaneous magnitude of the power line voltage.

However, by dynamically changing the frequency of the inverter's output voltage in accordance with some desired pattern or algorithm (at a 120 Hz frequency), the magnitude of the current drawn by the inverter from the power line can be made to change correspondingly over a wide range. More particularly, the current drawn from the power line can readily be made to conform to various desired waveshapes, such as those of FIG. 4, for instance.

q) With reference to FIG. 7*c*, which illustrates the waveshape of the voltage presented to main inverter MI of FIG. 5, it is noted that the instantaneous magnitude of this unidirectional voltage is equal to the larger of: (i) a certain substantially constant level (as represented by the DC voltage present on capacitor ESC); and (ii) the full-wave-rectified power line voltage which is provided across the output terminals of rectifier BR and which is illustrated by FIG. 7*b*).

In this connection, it is noted that the voltage-drop across current-sensing resistor csr is assumed to be of negligible magnitude in comparison with the magnitude of the DC voltage supplied to main inverter MI.

r) With reference to FIGS. 5 and 6, for convenience, all the circuitry connected between power input terminals PITa and PITb and power output terminals POT1 and POT2 may hereinafter collectively be referred-to as a conditioner circuit.

What is claimed is:

1. An arrangement comprising:

an AC source operative to provide an AC power line voltage at a pair of power line terminals;

a gas discharge lamp having a pair of lamp terminals; and conditioner circuit connected between the power line terminals and the lamp terminals; the conditioner circuit being characterized by:

(a) being operative to draw a low-frequency line current from the power line terminals;

(b) including an inverter sub-circuit powered from a unidirectional voltage whose instantaneous absolute magnitude is equal to the larger of: (i) the absolute instantaneous magnitude of a substantially constant DC voltage; and (ii) the absolute instantaneous magnitude of a sinusoidal voltage whose peak absolute magnitude is higher than that of the substantially constant DC voltage;

(c) being operative to draw current from the power line terminals even at times when the absolute instantaneous magnitude of the AC power line voltage is lower than that of the substantially constant DC voltage; and (d) supplying a high-frequency lamp current to the lamp terminals and thereby to the gas discharge lamp; the frequency of the high-frequency lamp current being substantially higher than that of the AC power line voltage; the crest factor of the high-frequency lamp current being equal to or lower than 1.7.

2. The arrangement of claim 1 wherein the conditioner circuit is additionally characterized by being operative to cause the instantaneous magnitude of the low-frequency line current to be substantially proportional to the instantaneous magnitude of the AC power line voltage.

3. The arrangement of claim 1 wherein the conditioner circuit is additionally characterized by including at least two separate inverter circuits; each inverter circuit having a pair of series-connected switching transistors.

4. The arrangement of claim 1 wherein the conditioner circuit is additionally characterized by including at least two separate inverter circuits; each inverter circuit being operative to provide a non-sinusoidal output voltage across a pair of inverter output terminals; the one inverter output voltage being substantially different from the other inverter output voltage.

5. An arrangement comprising:

an AC source operative to provide an AC power line voltage at a pair of power line terminals;

a gas discharge lamp having a pair of lamp terminals; and conditioner circuit connected between the power line terminals and the lamp terminals; the conditioner circuit being operative to draw a low-frequency line current from the power line terminals and to supply a high-frequency lamp current to the lamp terminals and thereby to the gas discharge lamp; the frequency of the high-frequency lamp current being substantially higher than that of the AC power line voltage; the conditioner circuit being further characterized by:

(a) being operative to cause: (i) the instantaneous magnitude of the low-frequency line current to be substantially proportional to the instantaneous magnitude of the AC power line voltage; and (ii) the crest factor of the high-frequency lamp current to be equal to or lower than 1.7; and (b) including: (i) a first inverter circuit having a first pair of DC power supply terminals across which is supplied a first DC voltage; and (ii) a second inverter circuit having a second pair of DC power supply terminals across which is supplied a second DC voltage; at least part of the time, the instantaneous magnitude of the second DC voltage being distinctly different from that of the first DC voltage.

6. The arrangement of claim 5 wherein the absolute instantaneous magnitude of the first DC voltage is substantially equal to the absolute instantaneous magnitude of an alternating voltage of sinusoidal waveform.

7. The arrangement of claim 6 wherein the conditioner circuit is additionally characterized in that frequency of said alternating voltage is equal to that of the AC power line voltage.

8. The arrangement of claim 7 wherein the conditioner circuit is additionally characterized in that it draws current from the power line terminals even during times when the absolute instantaneous magnitude of the first DC voltage is lower than that of the second DC voltage.

9. The arrangement of claim 5 wherein the conditioner circuit is additionally characterized by causing the low-frequency line current to have an instantaneous magnitude that is substantially proportional to that of the AC power line voltage.

10. An arrangement comprising:

an AC source operative to provide an AC power line voltage at a pair of power line terminals;

a gas discharge lamp having a pair of lamp terminals; and conditioner circuit connected between the power line terminals and the lamp terminals; the conditioner circuit being operative to draw a low-frequency line current from the power line terminals and to supply a high-frequency lamp current to the lamp terminals and thereby to the gas discharge lamp; the frequency of the high-frequency lamp current being substantially higher than that of the AC power line voltage; the conditioner circuit being further operative to cause the crest factor of the high-frequency lamp current to be equal to or lower than 1.7; the conditioner circuit being further characterized by:

(a) having a pair of DC power supply terminals across which exists a unidirectional supply voltage whose absolute instantaneous magnitude is equal to the sum of: (i) the absolute instantaneous magnitude of a substantially constant DC voltage; and (ii) the absolute instantaneous magnitude of an alternating voltage having a substantially sinusoidal waveshape; and (b) drawing current from the power line terminals even during periods when the absolute instantaneous magnitude of the alternating voltage is lower than that of the substantially constant DC voltage.

11. An arrangement comprising:

an AC source operative to provide an AC power line voltage at a pair of power line terminals;

a gas discharge lamp having a pair of lamp terminals; and conditioner circuit connected between the power line terminals and the lamp terminals; the conditioner circuit being operative to draw a low-frequency line current from the power line terminals and to supply a high-frequency lamp current to the lamp terminals and thereby to the gas discharge lamp; the frequency of the high-frequency lamp current being substantially higher than that of the AC power line voltage; the conditioner circuit being further characterized by:

(a) being operative to cause the crest factor of the high-frequency lamp current to be equal to or lower than 1.7;

(b) having a pair of DC terminals across which exists a unidirectional supply voltage whose absolute instantaneous magnitude is equal to the larger of: (i) the absolute magnitude of a substantially constant DC voltage; and (ii) the absolute instantaneous magnitude of an alternating voltage having a substantially sinusoidal waveform and a peak absolute magnitude higher than the absolute magnitude of the DC voltage; and (c) drawing current from the power line terminals even during times when the absolute instantaneous magnitude of the unidirectional supply voltage is equal to that of the substantially constant DC voltage.

12. An arrangement comprising:

an AC source operative to provide an AC power line voltage at a pair of power line terminals;

a gas discharge lamp having a pair of lamp terminals; and conditioner circuit connected between the power line terminals and the lamp terminals; the conditioner circuit being operative to draw a low-frequency line current from the power line terminals and to supply a high-frequency lamp current to the lamp terminals and thereby to the gas discharge lamp; the frequency of the high-frequency lamp current being substantially higher than that of the AC power line voltage; the conditioner circuit being further characterized by:

(a) being operative to cause the crest factor of the high-frequency lamp current to be equal to or lower than 1.7;

(b) having a pair of DC terminals across which exists a unidirectional supply voltage whose absolute instantaneous magnitude is equal to the larger of: (i) the absolute magnitude of a substantially constant DC voltage; and (ii) the absolute instantaneous magnitude of an alternating voltage having a substantially sinusoidal waveform and a peak absolute magnitude higher than the absolute magnitude of the substantially constant DC voltage; and (c) including: (i) a first transistor conducting periodically and intermittently at a frequency equal to the frequency of the high-frequency lamp current, and (ii) a second transistor conducting periodically and intermittently at a different frequency.

13. An arrangement comprising:

an AC source operative to provide an AC power line voltage at a pair of power line terminals;

a gas discharge lamp having a pair of lamp terminals; and conditioner circuit connected between the power line terminals and the lamp terminals; the conditioner circuit being operative to draw a low-frequency line current from the power line terminals and to supply a high-frequency lamp current to the lamp terminals and thereby to the gas discharge lamp; the frequency of the high-frequency lamp current being substantially higher than that of the AC power line voltage; the conditioner circuit being further characterized by having a pair of DC supply terminals across which exists a unidirectional supply voltage whose absolute instantaneous magnitude is equal to the sum of: (i) the absolute instantaneous magnitude of a substantially constant DC voltage; and (ii) the absolute instantaneous magnitude of an alternating voltage having a substantially sinusoidal waveform and a frequency equal to that of the AC power line voltage.

14. An arrangement comprising:

an AC source operative to provide an AC power line voltage at a pair of power line terminals;

a gas discharge lamp having a pair of lamp terminals; and conditioner circuit connected between the power line terminals and the lamp terminals; the conditioner circuit being operative to draw a low-frequency line current from the power line terminals and to supply a high-frequency lamp current to the lamp terminals and thereby to the gas discharge lamp; the frequency of the high-frequency lamp current being substantially higher than that of the AC power line voltage; the conditioner circuit being further characterized by having a pair of DC supply terminals across which exists a unidirectional supply voltage whose absolute instantaneous magnitude is equal to the sum of: (i) the absolute magnitude of a substantially constant DC voltage; and (ii) the absolute instantaneous magnitude of an alternating voltage having a substantially sinusoidal waveform and an absolute peak magnitude equal to at least half of the absolute magnitude of the substantially constant DC voltage.

15. The arrangement of claim 14 wherein the conditioner circuit is additionally characterized by causing the low-frequency line current to flow during at least 90% percent of each complete cycle of the AC power line voltage.

16. The arrangement of claim 14 wherein the conditioner circuit is additionally characterized by drawing current from the power line terminals during at least 90% of the total duration of each complete cycle of the AC power line voltage.

17. An arrangement comprising:

an AC source operative to provide an AC power line voltage at a pair of power line terminals;

a gas discharge lamp having a pair of lamp terminals; and conditioner circuit connected between the power line terminals and the lamp terminals; the conditioner circuit being operative to draw a low-frequency line current from the power line terminals and to supply a high-frequency lamp current to the lamp terminals and thereby to the gas discharge lamp; the frequency of the high-frequency lamp current being substantially higher than that of the AC power line voltage; the conditioner circuit being further characterized by: (a) drawing current from the power line terminals during more than 90% of the total duration of each complete cycle of the AC power line voltage; and (b) including a first inverter having a first transistor conducting periodically at a first frequency, and a second inverter having a second transistor also conducting periodically but at a frequency different from the first frequency.

18. The arrangement of claim 17 wherein the conditioner circuit is additionally characterized in that the low-frequency line current, when indeed being drawn, has an instantaneous magnitude that is substantially proportional to that of the AC power line voltage.

19. The arrangement of claim 17 wherein the conditioner circuit is additionally characterized by causing the high-frequency lamp current to have a crest factor no higher than about 1.7.

20. An arrangement comprising:

an AC source operative to provide an AC power line voltage at a pair of power line terminals;

a gas discharge lamp having a pair of lamp terminals; and conditioner circuit connected between the power line terminals and the lamp terminals; the conditioner circuit being operative to draw a low-frequency line current from the power line terminals and to supply a high-frequency lamp current to the lamp terminals and thereby to the gas discharge lamp; the frequency of the high-frequency lamp current being substantially higher than that of the AC power line voltage; the conditioner circuit being further characterized by: (a) drawing current from the power line terminals during more than 90% of the total duration of each complete cycle of the AC power line voltage; and (b) having a pair of DC terminals across which exists a DC voltage whose instantaneous absolute magnitude is the larger of (i) a substantially constant magnitude, and (ii) the instantaneous absolute magnitude of an alternating voltage whose peak absolute magnitude is larger than said substantially constant magnitude.

* * * * *